US011081827B2

(12) United States Patent
Eng-Kan

(10) Patent No.: US 11,081,827 B2
(45) Date of Patent: Aug. 3, 2021

(54) PROTECTING COVER AND BOARD EDGE CONNECTOR

(71) Applicant: Molex, LLC, Lisle, IL (US)

(72) Inventor: Soh Eng-Kan, Jurong Town (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/699,728

(22) Filed: Dec. 1, 2019

(65) Prior Publication Data

US 2020/0194921 A1 Jun. 18, 2020

(30) Foreign Application Priority Data

Dec. 13, 2018 (CN) ..... 201811524480.6

(51) Int. Cl.

| | |
|---|---|
| ***H01R 13/443*** | (2006.01) |
| ***H01R 12/72*** | (2011.01) |
| ***H01R 13/635*** | (2006.01) |
| ***H01R 13/627*** | (2006.01) |
| ***H01R 13/631*** | (2006.01) |

(52) U.S. Cl.

CPC ..... *H01R 13/443* (2013.01); *H01R 12/721* (2013.01); *H01R 13/6273* (2013.01); *H01R 13/631* (2013.01); *H01R 13/635* (2013.01)

(58) Field of Classification Search

CPC ..... H01R 12/721; H01R 13/443; H01R 13/6273; H01R 13/631; H01R 13/635

USPC ..... 439/148, 135

See application file for complete search history.

(56) References Cited

U.S. PATENT DOCUMENTS

| | | | | |
|---|---|---|---|---|
| 4,907,987 | A | 3/1990 | Douty et al. | |
| 5,026,295 | A * | 6/1991 | Fong | H01R 13/5213 439/135 |
| 5,558,528 | A | 9/1996 | Cheng et al. | |
| 5,571,025 | A | 11/1996 | Arai et al. | |
| 5,660,552 | A | 8/1997 | Suzuki et al. | |
| 5,944,549 | A * | 8/1999 | Po | H01R 12/83 439/326 |
| 6,319,022 | B1 | 11/2001 | Hwang | |
| 6,498,305 | B1 * | 12/2002 | Marketkar | G06F 13/4086 174/250 |
| 6,802,732 | B1 | 10/2004 | Bu et al. | |

(Continued)

FOREIGN PATENT DOCUMENTS

| | | |
|---|---|---|
| CN | 2800535 Y | 7/2006 |
| CN | 2805136 Y | 8/2006 |

(Continued)

*Primary Examiner* — Peter G Leigh

(57) ABSTRACT

The present disclosure provides a protecting cover and a board edge connector. The protecting cover is used to a board edge connector. An insulating housing of the board edge connector comprises a board edge slot and a tower portion at least positioned at an end of the board edge slot. Two positions of the tower portion provide a guiding groove and a pair of clamping arms, the guiding groove and the pair of clamping arms are spaced apart from each other, therefore, in the mating process and the unmating process, it maintains stable path and position and provides a holding force. A side edge portion of the protecting cover comprises a stopping block. The stopping block can correspondingly stop onto an inner wall of the tower portion, prevent warpage or deflection deformation of the insulating housing.

13 Claims, 32 Drawing Sheets

(56) References Cited

U.S. PATENT DOCUMENTS 6,824,407 B1 * 11/2004 Zhao ..... H01R 12/721 439/157
6,837,722 B2 * 1/2005 Sakamoto ..... H01R 13/5213 439/135
7,438,569 B2 * 10/2008 Pennypacker ..... H01R 13/6335 439/157
7,484,978 B1 2/2009 Gao
7,789,681 B2 * 9/2010 Guan ..... H01R 12/7005 439/157
7,828,564 B2 * 11/2010 Guan ..... H01R 12/721 439/135
7,938,658 B1 * 5/2011 Zeng ..... H01R 12/7029 439/160
7,955,098 B1 * 6/2011 McKee ..... H01R 13/62988 439/157
8,403,689 B2 * 3/2013 Li ..... H01R 13/639 439/160
8,553,423 B2 * 10/2013 Sun ..... G06F 1/185 361/759
8,858,257 B2 * 10/2014 Mo ..... H01R 13/62977 439/578
9,033,724 B2 * 5/2015 Lai ..... H01R 13/6271 439/328
9,385,452 B2 * 7/2016 Fu ..... H01R 12/7005
9,385,453 B2 * 7/2016 Yang ..... H05K 7/1409
9,553,401 B2 * 1/2017 Mathews ..... H01R 13/6275
9,876,314 B1 * 1/2018 Cai ..... H01R 13/62938

FOREIGN PATENT DOCUMENTS

CN 101964465 A 2/2011
CN 102044770 A 5/2011
CN 206004071 U 3/2017
TW I625003 B 5/2018

* cited by examiner

24

24

24

24

24

PROTECTING COVER AND BOARD EDGE CONNECTOR

RELATED APPLICATION

This application claims priority to Chinese Application No, 201811524480.6, filed on Dec. 13, 2018, which application is incorporated herein by reference in its entirety.

TECHNICAL FIELD

The present disclosure relates to a protecting cover and a board edge connector, more particularly, the present disclosure relates to a protecting cover used to a board edge connector and a board edge connector used to mate with a board edge of a board edge module.

BACKGROUND

U.S. Pat. No. 7,828,564 discloses a card edge connector assembly comprising an auxiliary member (acts as a pick and place member), the auxiliary member is vertically provided and has a flat plate shape. The auxiliary member comprises a connection portion, a horizontal absorbed surface (acts as pick and place portion) and a pair of fixing portions, the horizontal absorbed surface is horizontally provided on the connection portion. The auxiliary member which is vertically provided and has the flat plate shape does not easily maintain verticality so as to make the horizontal absorbed surface maintained horizontality and in turn make the absorbing device to more easily pick and place. Therefore, it needs to provide a flange (acts as a rib) on the fixing portion to closely abut an inner wall of a latch portion of a card edge connector.

Moreover, the auxiliary member disclosed in the above patent can not cover a central card slot of the card edge connector. Therefore, a plurality of terminals spaced apart along the central card slot will be easily contaminated in a process that the card edge connector is welded to a printed circuit board, in a process that the assembly is transported in traffic or before a card is inserted into the card edge connector for use.

Moreover, the housing of the card edge connector easily generates warpage or deflection deformation in the high temperature process of welding the circuit board, the terminals will not be coplanar, which in turn results in that welding is poor or welding cannot be performed. Therefore, how to prevent warpage or deflection deformation of the housing of the card edge connector and maintain the terminals to have good coplanarity is a problem to be necessarily overcome.

U.S. Pat. No. 6,802,732 discloses an electrical connector. The electrical connector may allow an electronic card to mate therewith. The electrical connector comprises an insulating body. The insulating body comprises an elongated base and an arm portion extending forwardly from at least one end of the base. A receiving space is formed in the arm portion and is used to receive a side edge of the electronic card, and a pair of elastic clamping arms are formed by extend downwardly from two side walls of the arm portion which face the receiving space, and the pair of elastic clamping arms can elastically clamp the electronic card. The pair of elastic clamping arms may provide reliable holding for the side edge of the electronic card which is inserted therein and provide a certain of function of reducing vibration.

Although the pair of elastic clamping arms can elastically clamp the electronic card, because the elastic clamping arms are provided in the receiving space but there is no other member in the receiving space to limit the position of the side edge of the electronic card (for example, a width of a space below the elastic clamping arms is larger than an interval between the pair of elastic clamping arms), essentially the position the side edge of the electronic card is limited only depending on the elastic clamping arms. The elastic clamping arm inherent has elasticity, especially at a tail end of the elastic clamping arm, elasticity is more obvious. Therefore, the tail ends of the elastic clamping arms can not effectively limit the position of the side edge of the electronic card. In the process that the electronic card is inserted, as long as a force which is not stable in vertical direction is applied to the electronic card, the electronic card may be shaken under the force or the electronic card may be is inserted in a skewed orientation. As a result, it is quite possible to damage the electronic card and the terminals.

The above description of the "background" merely provides a background, and it is not admitted that the above description of "background" discloses the object of the present disclosure, and the above description of "background" does not constitute the background of the present disclosure, any above description of the "background" should not be considered as any part of the present disclosure.

SUMMARY

An embodiment of the present disclosure provides a protecting cover. The protecting cover is used to a board edge connector. The board edge connector comprises an insulating housing and a plurality of conductive terminals. The insulating housing is elongated and extends in a length direction. The insulating housing comprises a board edge slot and at least one tower portion. The tower portion is positioned at an end of the board edge slot. The tower portion has an inner wall facing the board edge slot. The conductive terminals are mounted in the board edge slot. The protecting cover is detachably mounted on the insulating housing. The protecting cover comprises a body portion and at least one side edge portion. The body portion extends in the length direction. The side edge portion is positioned at an end of the body portion. The side edge portion comprises at least one stopping block. The stopping block can correspondingly stop onto the inner wall of the tower portion.

In some embodiments, the stopping block is close to an upper end of the inner wall of the tower portion.

In some embodiments, the insulating housing has a width in a width direction. The side edge portion comprises two stopping blocks respectively positioned at two side surfaces of the side edge portion in the width direction.

In some embodiments, the protecting cover comprises two side edge portions respectively positioned at two ends of the body portion and stopping blocks respectively provided on the two side edge portions. Two ends of the board edge slot respectively each have a tower portion. The stopping blocks on the two side edge portions respectively correspond to the inner walls of the two tower portions.

In some embodiments, the body portion of the protecting cover has a bottom surface, the bottom surface covers the board edge slot.

In some embodiments, the inner wall of the tower portion comprises a guiding groove communicated with the board edge slot and a pair of clamping arms spaced apart from the guiding groove and positioned alongside the guiding groove, the pair of clamping arms are respectively integrally configured on two side walls of the tower portion and extend upwardly, the side edge portion of the protecting cover is inserted into the guiding groove and is inserted into between the pair of clamping arms, the pair of clamping arms clamp the side edge portion.

In some embodiments, the side edge portion is inserted into the tower portion of the board edge connector, the side edge portion of the protecting cover comprises a latching notch. The board edge connector comprises a latching member, the latching member is provided in the tower portion of the insulating housing. The latching member comprises a latching portion and an ejecting portion. The latching portion is configured to latch with the latching notch of the side edge portion of the protecting cover in a locking position. The ejecting portion is configured to eject out the side edge portion of the protecting cover in an unlocking position.

An embodiment of the present disclosure provides a board edge connector. The board edge connector comprises an insulating housing. The insulating housing is elongated and extends in a length direction. The insulating housing comprises a board edge slot; and at least one tower portion. The tower portion is positioned at an end of the board edge slot. The tower portion comprises an inner wall and a pair of clamping arms. The inner wall faces the board edge slot. The inner wall comprises a guiding groove communicated with the board edge slot. The pair of clamping arms are positioned in the tower portion, spaced apart from the guiding groove and positioned alongside the guiding groove, an interval between the pair of clamping arms is smaller than a width of the guiding groove.

In some embodiments, the pair of clamping arms are respectively integrally configured on two side walls of the tower portion and extend upwardly.

In some embodiments, the tower portion comprises a position limiting surface. The position limiting surface is positioned in the tower portion, spaced apart from the pair of clamping arms and positioned alongside the pair of clamping arms.

In some embodiments, the tower portion comprises a partitioning wall. The partitioning wall is positioned in the tower portion and positioned alongside the pair of clamping arms. The partitioning wall comprises an inner surface. The inner surface faces the board edge slot and acts as the position limiting surface.

In some embodiments, the tower portion comprises a partitioning wall and a metal reinforcement member. The partitioning wall is positioned in the tower portion and positioned alongside the pair of clamping arms. The partitioning wall comprises a wall surface. The wall surface faces the board edge slot. The metal reinforcement member is positioned on the wall surface of the partitioning wall. The metal reinforcement member comprises an inner surface. The inner surface faces the board edge slot and acts as the position limiting surface.

In some embodiments, the metal reinforcement member further comprises a guiding edge which bends toward an outer side direction. The guiding edge which bends toward an outer side direction is positioned at an upper edge of the metal reinforcement member.

In some embodiments, the board edge connector is used to receive a board edge module. The board edge module has a side board edge portion. The side board edge portion comprises a latching notch. The board edge connector further comprises a latching member. The latching member is provided in the tower portion of the insulating housing. The latching member comprises a latching portion and an ejecting portion. The latching portion is configured to latch with the latching notch of the board edge module in a locking position. The ejecting portion is configured to eject out the side board edge portion of the board edge module in an unlocking position.

In some embodiments, the board edge connector is used to receive a board edge module. The board edge module has a side board edge portion. The side board edge portion comprises a latching notch. The board edge connector further comprises: a latching member and a pushing member. The latching member comprises a latching portion, an ejecting portion and a following bar. The latching portion is configured to latch with the latching notch of the board edge module in a locking position. The ejecting portion and the latching portion are positioned at two ends of the latching member. The pushing member comprises a pushing bar. The pushing bar is configured to push down the following bar of the latching member in an unlocking position, the ejecting portion of the latching member responses to a movement of the following bar pushed down and ejects out the side board edge portion of the board edge module.

In the present disclosure, the protecting cover can cover the contact portions of the conductive terminals in the board edge slot. Therefore, the protecting cover has function of dustproof and anti-contamination. Moreover, the protecting cover further provides a configuration and a function for sucking up. The protecting cover further provides a configuration which can stop the at least one tower portion of the insulating housing, can effectively alleviate or eliminate warpage or deflection deformation of the insulating housing of the board edge connector in the high temperature process of welding the circuit board, and thus maintain that the conductive terminal has better coplanarity.

Moreover, in the present disclosure, the components which provide the function of guiding the side board edge portion are combined as one element (the guiding groove provided on the inner wall which is rigid), the components which provide the holding force for the side board edge portion in the unmating process are combined as another element (the pair of clamping arms). That is, the two functions respectively employ two different members to perform. Specifically, a guiding groove which is rigid and a pair of clamping arms which are elastic are provided at two positions of the same one tower portion and are spaced apart from each other. Therefore, the guiding groove which is rigid can make the side board edge portion to maintain stable path and position in the mating process and the unmating process. The pair of clamping arms provide a holding force for the side board edge portion in the unmating process. After the unmating process of the board edge module completed and before a user takes down the board edge module, the board edge module still can be held on the board edge connector.

The technical features and advantages of the present disclosure are widely and generally described as above, so the detailed description of the present disclosure can be better understood. Other technical features and advantages constituting the objects of the technical solutions of the present disclosure will be described below. It is to be understood by those of ordinary skill in the art that, the concept and specific embodiments disclosed below may be quite easily used to make modification or design other configuration or process to realize the same objects of the present disclosure. It is to be understood by those of ordinary skill in the art that these equivalent configurations can not depart from the spirit and scope of the present disclosure as defined by the appended technical solutions.

BRIEF DESCRIPTION OF THE DRAWINGS

Referring to the detailed description and the technical solutions in combination with the drawings, the disclosed contents of the present disclosure can be fully understood, the same reference numeral indicates the same element in the drawings

DETAILED DESCRIPTION

Figure 1:
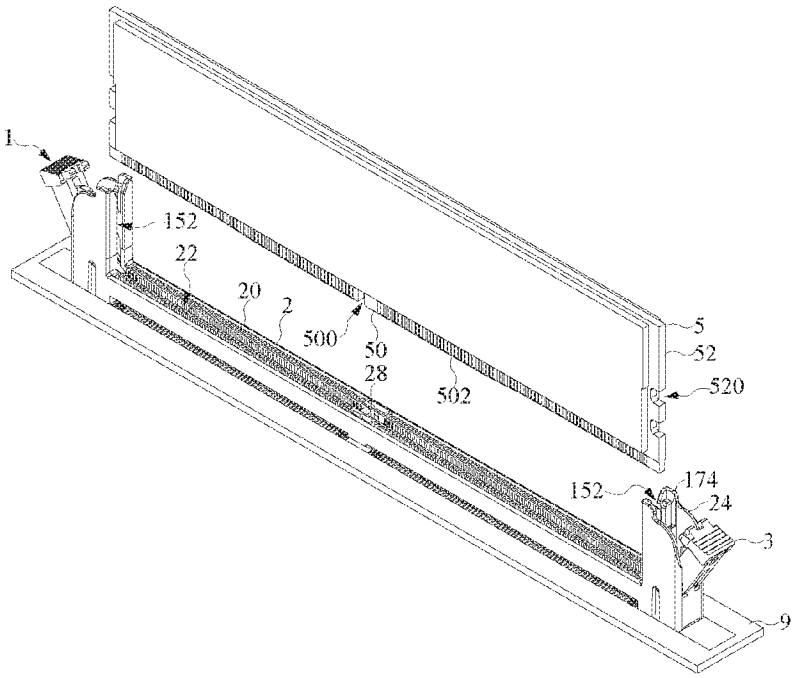
FIG. 1 is an exploded top perspective schematic view of a board edge module and a board edge connector.

Embodiments or examples of the content of the present disclosure shown in the drawings are described in a specific language. It is to be understood that this is not intended to limit the scope of the present disclosure. Any variations or modifications of the described embodiments, as well as any further applications of the principles described herein, will normally occur to those skilled in the art. The reference numerals may be repeated in each embodiment, but even if the elements have the same reference numeral, the features in the embodiment are not necessarily used in another embodiment.

It will be understood that the various elements, assemblies, regions, layers or sections may be described herein using the terms first, second, third, etc., however, these elements, assemblies, regions, layers or sections are not limited to these terms. These terms are only used to distinguish one element, assembly, region, layer or section from another element, assembly, region, layer or section. The first element, assembly, region, layer or section described below may be referred to as a second element, assembly, region, layer or section without departing from the teachings of the inventive concept of the present disclosure.

The words used in the present disclosure are only used for the purpose of describing the specific exemplary embodiments and are not intended to limit the concept of the present disclosure. As used herein, "a" and "the" in singular are also used to contain plural, unless otherwise expressly indicated herein. It is to be understood that the word "comprise" used in the specification specifically indicates the existence of a feature, integer, step, operation, element or assembly which is described, but does not excludes the existence of one or more other features, integers, steps, operations, elements, assemblies or groups thereof.

Figure 13:
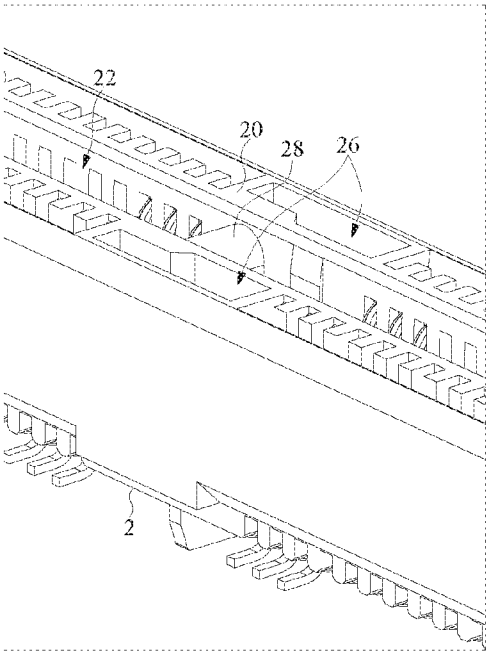
FIG. 13 is a partial enlarged perspective schematic view of FIG. 2 indicted by a region A.

FIG. 1 is an exploded top perspective schematic view of a board edge module 5 and a board edge connector 1. Referring to FIG. 1, the board edge connector 1 is welded to a circuit board 9, and may be used to receive the board edge module 5. The board edge module 5 comprises a lower board edge portion 50 and two side board edge portions 52. The board edge module 5 further comprises a positioning notch 500 provided on the lower board edge portion 50. The positioning notch 500 of the board edge module 5 is engaged with a positioning block 28 of the board edge connector 1 (as shown in FIG. 1 and FIG. 13). If the board edge module 5 is accidentally placed onto the board edge connector 1 in an orientation that the board edge module 5 is reversed to the orientation as shown in FIG. 1, for example, is rotated by 180 degrees, the board edge module 5 cannot successfully mate with the board edge connector 1. Hereby, it can prevent improperly mating. In some embodiments, board edge module 5 comprises a memory card module, for example, double data rate synchronous DRAM, such as DDR SDRAM, DDR2 SDRAM or DDR3 SDRAM.

Figure 2:
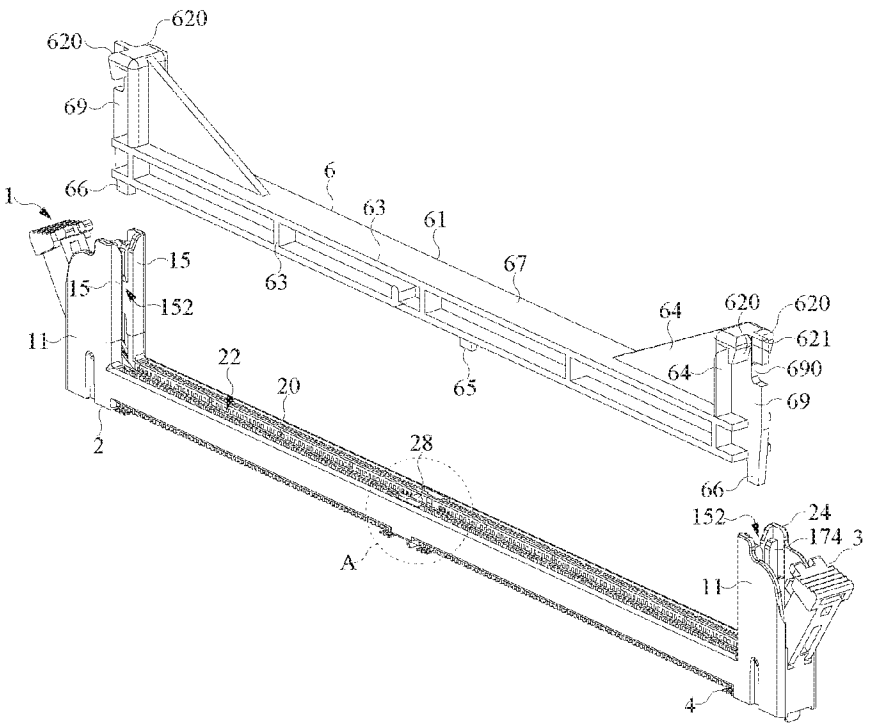
FIG. 2 is an exploded top perspective schematic view of a protecting cover and the board edge connector.
Figure 3:
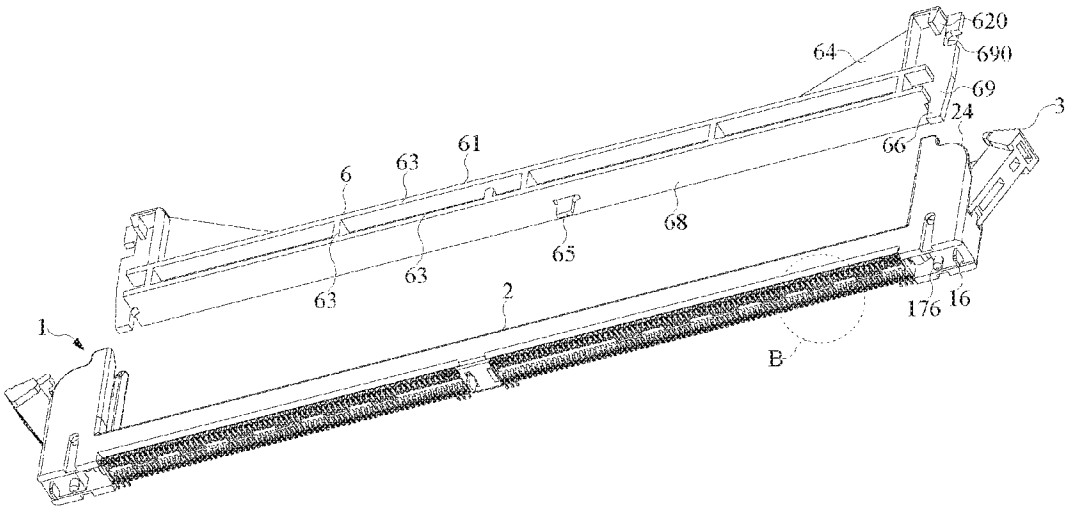
FIG. 3 is an exploded bottom perspective schematic view of the protecting cover and the board edge connector of FIG. 2.
Figure 27:
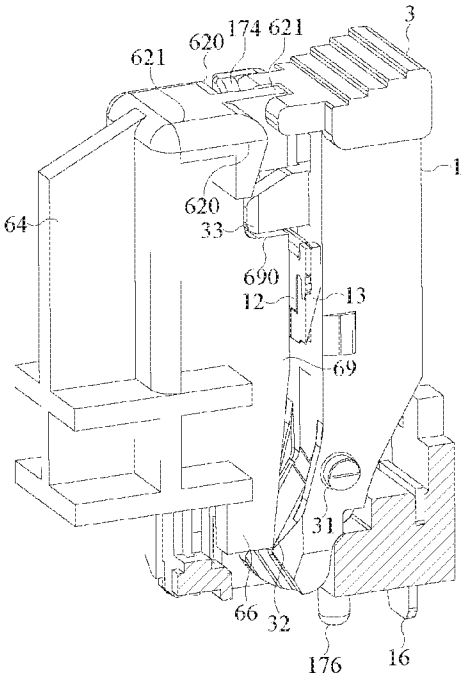
FIG. 27 is a cross sectional perspective schematic view of the protecting cover and the board edge connector of FIG. 25 in the locking position, with a side wall of the tower portion cut.

FIG. 2 is an exploded top perspective schematic view of a protecting cover 6 and the board edge connector 1. FIG. 3 is an exploded bottom perspective schematic view of the protecting cover 6 and the board edge connector 1 of FIG. 2. Referring to FIG. 2 and FIG. 3, the protecting cover 6 is used to mount on the board edge connector 1. Specifically, after the protecting cover 6 is placed onto the board edge connector 1, the board edge connector 1 locks the protecting cover 6, which is shown in FIG. 27 in detail. After the mounting is completed, a vacuum nozzle or a suction head may be used to automatically pick and place the board edge connector 1 by sucking up the protecting cover 6. When it does not need the protecting cover 6, for example, during or after high temperature process or when it is intended to insert the board edge module 5 for use (as shown in FIG. 1), the board edge connector 1 unlocks the protecting cover 6, which is shown FIG. 28 in detail.

Figure 4:
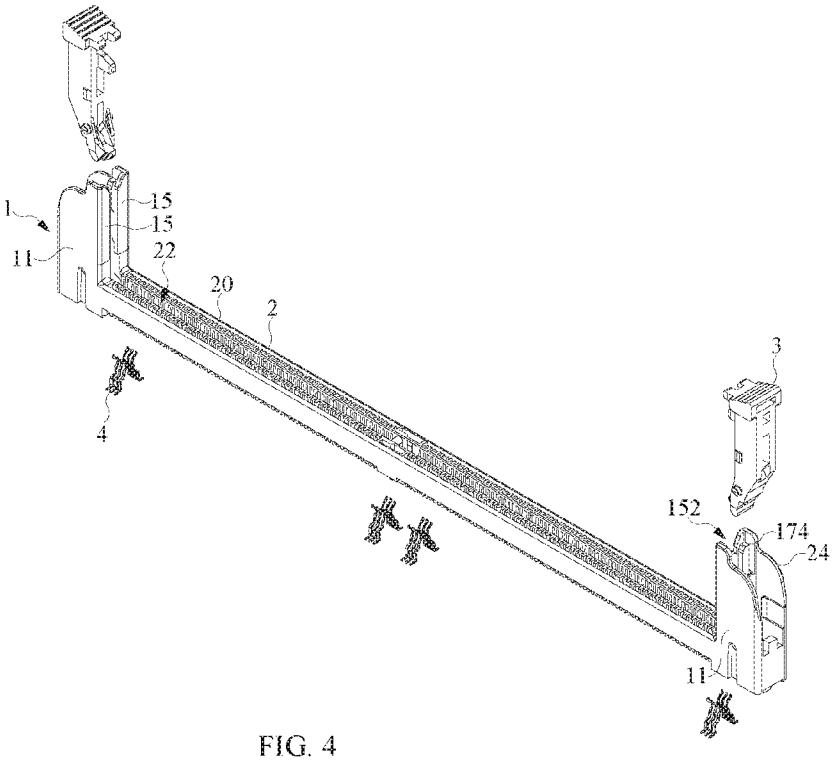
FIG. 4 is an exploded top perspective schematic view of the board edge connector of FIG. 2.
Figure 5:
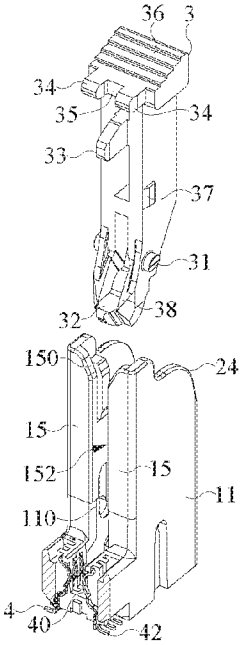
FIG. 5 is an exploded partial top perspective schematic view of an insulating housing and a latching member of the board edge connector of FIG. 4.
Figure 6:
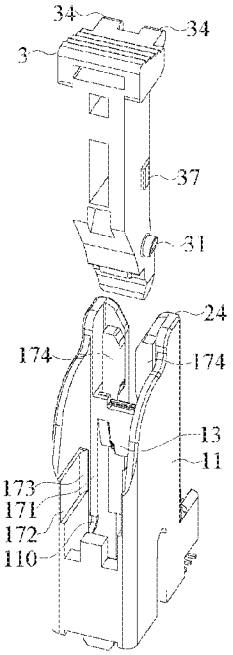
FIG. 6 is an exploded partial top perspective schematic view of the insulating housing and the latching member of FIG. 5 from another angle.
Figure 7:
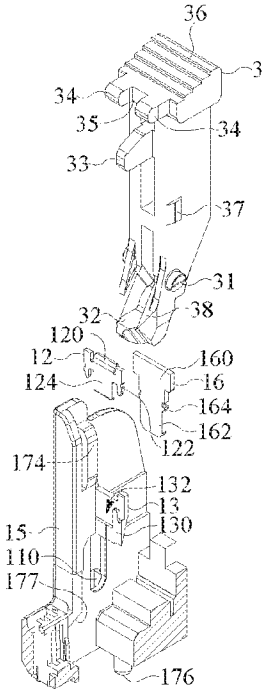
FIG. 7 is an exploded cross sectional perspective schematic view of the insulating housing and the latching member of FIG. 5, with a side wall of a tower portion of the insulating housing cut.
Figure 8:
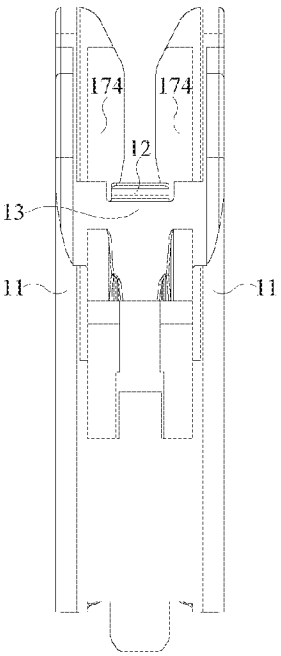
FIG. 8 is a plane schematic view of the tower portion of the board edge connector of FIG. 5 viewed from outside to inside.
Figure 9:
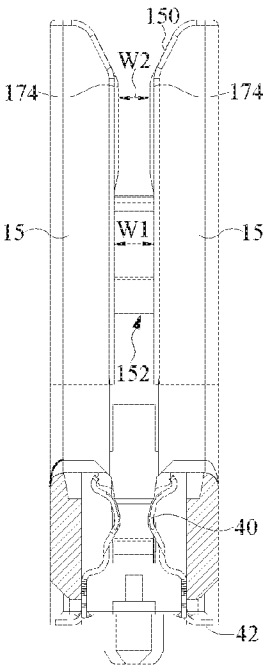
FIG. 9 is a plane schematic view of the tower portion of the board edge connector of FIG. 5 viewed from inside to outside.
Figure 10:
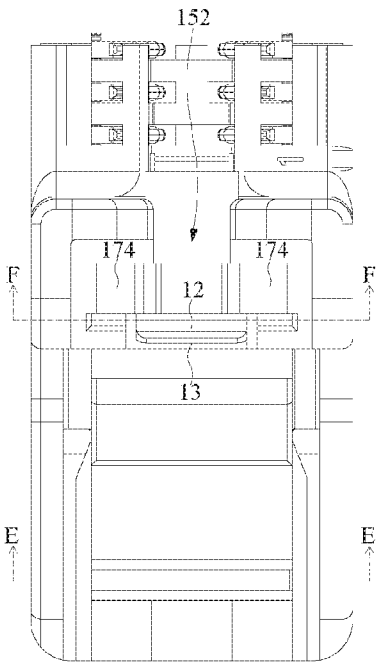
FIG. 10 is a top plane schematic view of the tower portion of the board edge connector of FIG. 5.
Figure 11:
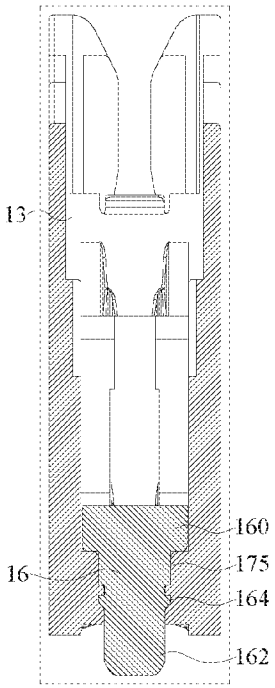
FIG. 11 is a cross sectional plane schematic view taken along a line E-E of FIG. 10.
Figure 12:
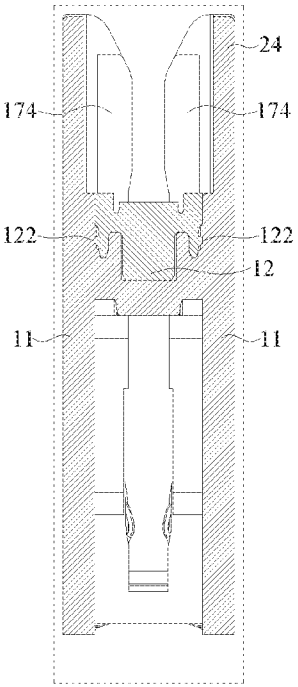
FIG. 12 is a cross sectional plane schematic view taken along a line F-F of FIG. 10.
Figure 14:
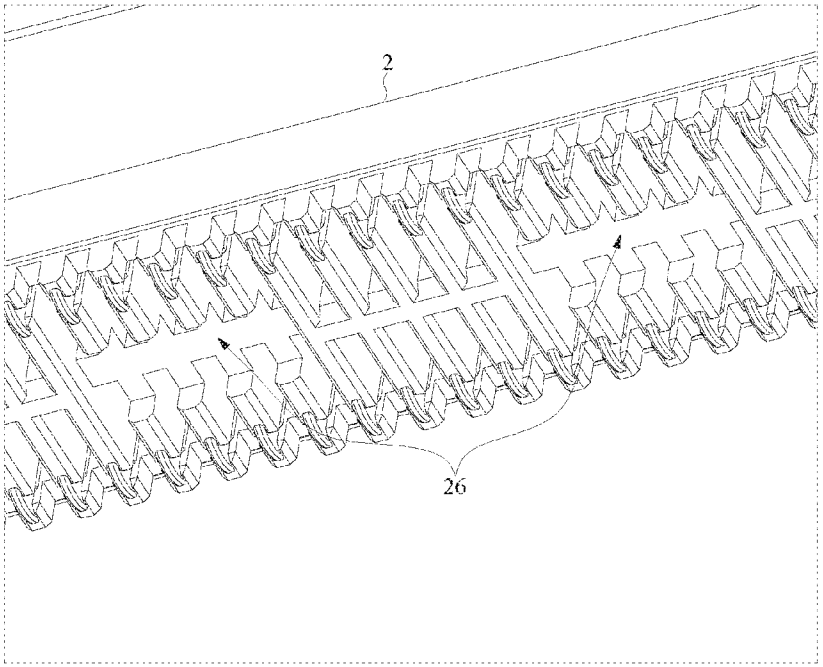
FIG. 14 is a partial enlarged perspective schematic view of FIG. 3 indicted by a region B.

FIG. 4 is an exploded top perspective schematic view of the board edge connector 1 of FIG. 2. FIG. 5 is an exploded partial top perspective schematic view of an insulating housing 2 and a latching member 3 of the board edge connector 1 of FIG. 4. FIG. 6 is an exploded partial top perspective schematic view of the insulating housing 2 and the latching member 3 of FIG. 5 from another angle. FIG. 7 is an exploded cross sectional perspective schematic view of the insulating housing 2 and the latching member 3 of FIG. 5, with a side wall 11 of a tower portion 24 of the insulating housing 2 cut. FIG. 8 is a plane schematic view of the tower portion 24 of the board edge connector 1 of FIG. 5 viewed from outside to inside. FIG. 9 is a plane schematic view of the tower portion 24 of the board edge connector 1 of FIG. 5 viewed from inside to outside. FIG. 10 is a top plane schematic view of the tower portion 24 of the board edge connector 1 of FIG. 5. FIG. 11 is a cross sectional plane schematic view taken along a line E-E of FIG. 10. FIG. 12 is a cross sectional plane schematic view taken along a line F-F of FIG. 10. FIG. 13 is a partial enlarged perspective schematic view of FIG. 2 indicted by a region A. FIG. 14 is a partial enlarged perspective schematic view of FIG. 3 indicted by a region B.

Referring to FIG. 4 to FIG. 12, the board edge connector 1 comprises an insulating housing 2, at least one latching member 3 and a plurality of conductive terminals 4. For sake of clarity and conciseness, the value of quantity is omitted in some later contents.

The insulating housing 2 is elongated, extends in a length direction and has a width in a width direction. The board edge module 5 of FIG. 1 or the protecting cover 6 of FIG. 2 is detachably mounted on the insulating housing 2. The insulating housing 2 comprises a board edge slot 22 provided on a mating face 20, and the insulating housing 2 comprises at least one tower portion 24 positioned at an end of the board edge slot 22 and extending in a height direction.

The conductive terminals 4 are assembled in the board edge slot 22. Each tail portion 42 of the conductive terminals 4 may be welded on the circuit board 9 to electrically connect the circuit board 9 (as shown in FIG. 1). The tail portion 42 of the conductive terminal 4 may be parallel to the circuit board 9 as shown in the embodiment to allow the surface welding (as shown in FIG. 5), also may be changed to be perpendicular to the circuit board 9 to allow the through hole welding. The board edge slot 22 may be an elongated card slot. The board edge slot 22 may be used to receive the board edge module 5 or the protecting cover 6.

The latching member 3 is provided in the tower portion 24 of the insulating housing 2, and is configured to pivot in the tower portion 24. In the embodiment, two tower portions 24 are respectively positioned at two ends of the board edge slot 22. However, the present disclosure is not limited thereto. Other embodiments of the present disclosure may further include an embodiment that the insulating housing 2 comprises single tower portion 24.

In the present disclosure, with respect to the tower portion 24, in the length direction, a direction which faces the board edge slot 22 is an inner side direction, and a direction which is away from the board edge slot 22 is an outer side direction. The tower portion 24 comprises two side walls 11 facing in the width direction, an inner wall 15 facing the board edge slot 22, a guiding groove 152 provided on the inner wall 15 and communicated with the board edge slot 22, a pair of clamping arms 174 positioned in the tower portion 24 and positioned alongside the guiding groove 152, a partitioning wall 13, a metal reinforcement member 12, a board positioning member 16, a positioning groove 175 positioned at a bottom of the tower portion 24, a positioning post 176 positioned a bottom surface of the insulating housing 2, a first groove 171, a second groove 172 and a protruding portion 173.

Referring to FIG. 9, the guiding groove 152 has an interval W1, the interval Wlis larger than a thickness of the board edge module 5. The guiding groove 152 provided on the inner wall 15 which is rigid can make the board edge module 5 to maintain stable path and position in the mating process and the unmating process. The pair of clamping arms 174 are spaced apart from the guiding groove 152 and provided alongside the guiding groove 152 in the outer side direction, the pair of clamping arms 174 are respectively integrally configured on the two side walls 11 of the tower portion 24 and extend upwardly. Therefore, the pair of clamping arms 174 can provide better holding force. There is an interval W2 between the pair of clamping arms 174, the interval W2 is smaller than the thickness of the board edge module 5. That is, the interval W2 between the pair of clamping arms 174 is smaller than the interval W1 of the guiding groove 152. Therefore, the pair of clamping arms 174 provide a holding force for the side board edge portion 52 of the board edge module 5 in the unmating process of the board edge module 5. After the unmating process of the board edge module 5 completed and before a user takes down the board edge module 5, the board edge module 5 still can be held on the board edge connector 1. In a word, in the present disclosure, the components which provide the function of guiding the board edge module 5 are combined as one element (the guiding groove 152), and the components which provide the holding force for the side board edge portion 52 of the board edge module 5 in the unmating process are combined as another element (the pair of clamping arms 174).

Referring to FIG. 6 and FIG. 7, the partitioning wall 13 is positioned in the tower portion 24, spanned between the two side walls 11 of the tower portion 24, spaced apart from the pair of clamping arms 174 and positioned alongside the pair of clamping arms 174 in the outer side direction. In some embodiments, the partitioning wall 13 and the two side walls 11 are integrally formed. The partitioning wall 13 comprises a wall surface 130. The wall surface 130 faces the board edge slot 22.

The metal reinforcement member 12 is provided on an inner side wall surface 130 of the partitioning wall 13 and positioned alongside the pair of clamping arms 174. More specifically, the metal reinforcement member 12 is mounted in a mounting groove 132 on the inner side wall surface 130 of the partitioning wall 13. The metal reinforcement member 12 spans between the two side walls 11 of the tower portion 24. Because the metal reinforcement member 12 is high in strength, when the two side walls 11 are splayed, the metal reinforcement member 12 will not be broken. Therefore, it may maintain the shape of the tower portion 24, allow that latching member 3 always may maintain normal operation. Moreover, the metal reinforcement member 12 may act as guiding or limiting the mating position of the board edge module 5 when the board edge module 5 is inserted. When the board edge module 5 is mounted improperly and collides the metal reinforcement member 12, because the metal reinforcement member 12 has a sufficient strength, it may avoid the metal reinforcement member 12 being broken due to collision.

The metal reinforcement member 12 comprises an inner surface 124. The inner surface 124 faces the board edge slot 22, and acts as a position limiting surface in the length direction with respect to the board edge module 5. However, the present disclosure is not limited thereto. In some embodiments, the tower portion 24 may comprise a position limiting surface, the position limiting surface is positioned in the tower portion 24 and positioned alongside the pair of clamping arms 174. In addition, in other embodiments, the tower portion 24 may comprise a partitioning wall 13, the partitioning wall 13 comprise an inner surface, the inner surface faces the board edge slot 22 and acts as position limiting surface.

The metal reinforcement member 12 further comprise a guiding edge 120 which bends toward the outer side direction and interfering protrusions 122 which are positioned at two sides of the metal reinforcement member 12. The guiding edge 120 which bends toward the outer side direction is positioned at an upper edge of the metal reinforcement member 12, and is configured to guide the board edge module 5 to self align with and insert into the board edge slot 22 in the process of mating of the board edge module 5. Moreover, when the board edge module 5 is inserted into the board edge slot 22, the guiding edge 120 which bends toward the outer side direction also may prevent a corner between the side board edge portion 52 and the lower board edge portion 50 of the board edge module 5 from collision to be damaged. The interfering protrusions 122 positioned at the two sides of the metal reinforcement member 12 will interfere with the mounting groove 132 to fix the metal reinforcement member 12.

Referring to FIG. 7, in the embodiment, the board positioning member 16 is a T-shaped board positioning member. The board positioning member 16 comprises a head 160, a tail 162 and two interfering protrusions 164. Referring to FIG. 11, the board positioning member 16 is inserted into a positioning groove 175 of the tower portion 24 from up to down. The head 160 of the board positioning member 16, which for example is a T-shaped head, fitted to an upper end of the positioning groove 175. The two interfering protrusions 164 of the board positioning member 16 interfere with wall surfaces of the positioning groove 175, thereby fixing the board positioning member 16, the tail 162 of the board positioning member 16 extends out of the positioning groove 175 to protrude from the bottom surface of the insulating housing 2. When the board edge connector 1 is mounted on the circuit board 9, the positioning post 176 of the tower portion 24 is positioned in a positioning hole (not shown) on the circuit board 9, the tail 162 of the board positioning member 16 is inserted into a hole of the circuit board 9.

Referring to FIG. 13 and FIG. 14, the insulating housing 2 further comprises a plurality of material cut away portions 26. The material cut away portion 26 comprises a recessed groove positioned at a top surface (acts as the mating face) of the insulating housing 2, or a recessed groove positioned at the bottom surface of the insulating housing 2. These recessed grooves are formed by removing a part of the insulating housing 2. The material cut away portion 26 may reduce warpage or deflection deformation of the insulating housing 2.

Returning to refer to FIG. 5 to FIG. 7, the latching member 3 comprises two pivoting shafts 31, an ejecting portion 32, a latching portion 33, a triggering portion 36 and two buckle blocks 37. The latching member 3 is pivoted to the insulating housing 2 by that the pivoting shafts 31 are respectively engaged with pivoting holes 110 provided to the side walls 11 of the tower portion 24. The triggering portion 36 comprises a recess portion 35 positioned at a front end in the inner side direction and two position limiting protruding portions 34 positioned at two sides of the recess portion 35.

Figure 15:
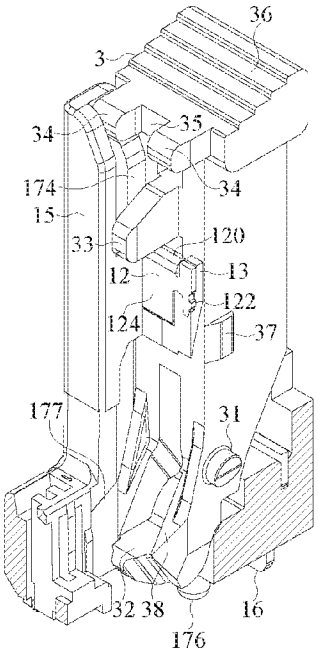
FIG. 15 is a cross sectional perspective schematic view with the latching member of FIG. 7 assembled and positioned in a locking position.
Figure 16:
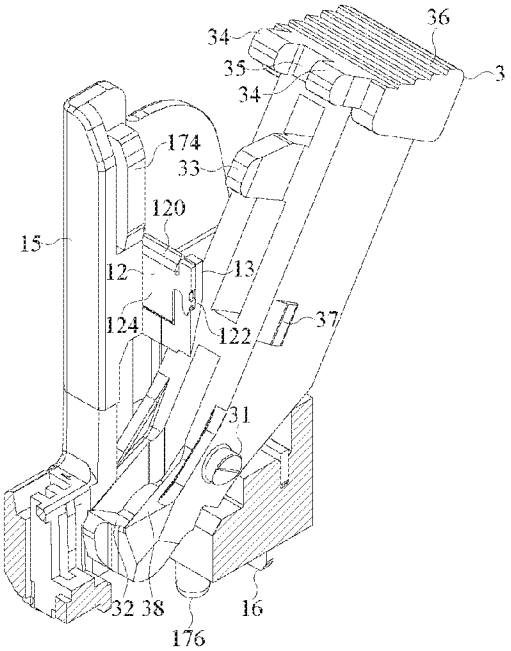
FIG. 16 is a cross sectional perspective schematic view with the latching member of FIG. 15 in an unlocking position.
Figure 17:
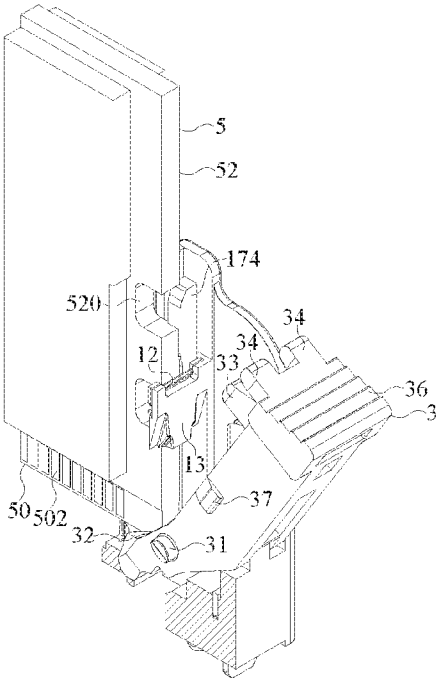
FIG. 17 is a cross sectional perspective schematic view with the latching member of FIG. 16 in the unlocking position and viewed from another angle, in which the board edge module is shown.
Figure 18:
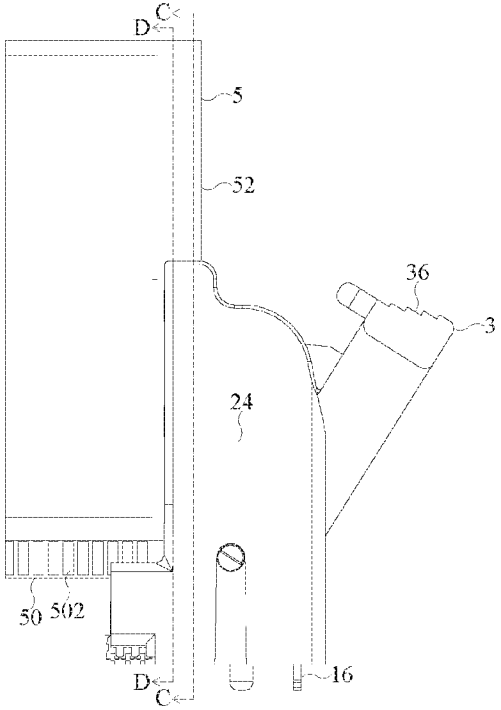
FIG. 18 is a plane schematic view of the board edge module and the latching member of FIG. 17 in the unlocking position.
Figure 19:
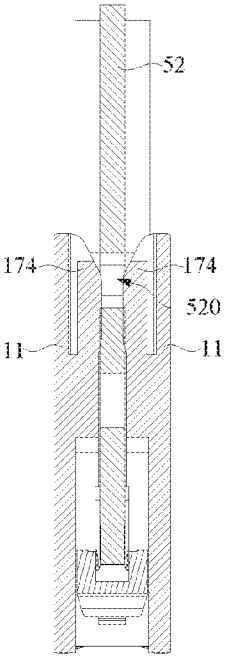
FIG. 19 is a cross sectional plane schematic view of taken along a line C-C of FIG. 18.
Figure 20:
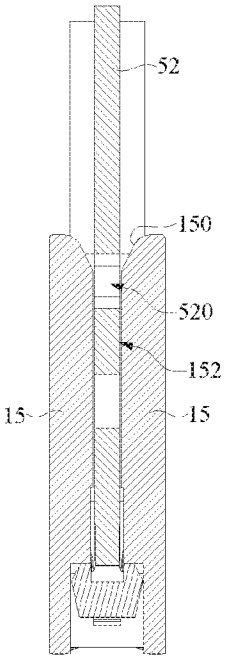
FIG. 20 is a cross sectional plane schematic view taken along a line D-D of FIG. 18.
Figure 21:
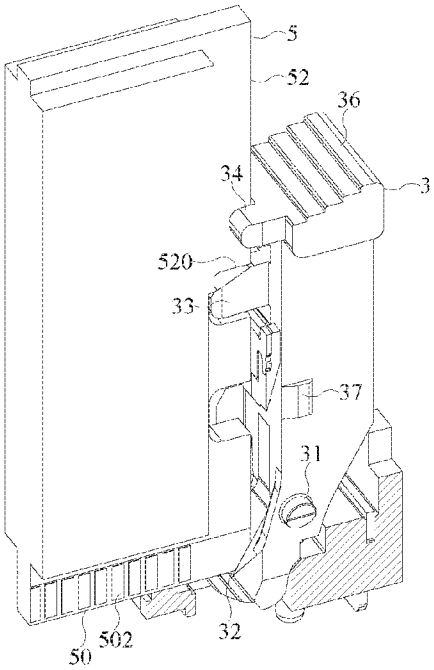
FIG. 21 is a cross sectional perspective schematic view of the board edge module and the latching member of FIG. 15 in the locking position viewed from another angle, with the board edge module shown.
Figure 22:
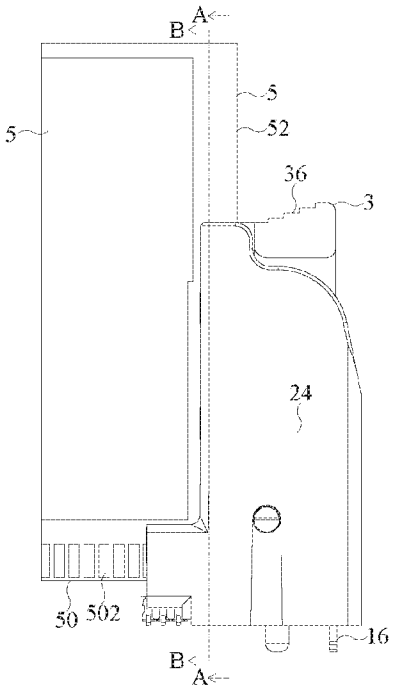
FIG. 22 is a plane schematic view of the board edge module and the latching member of FIG. 21 in the locking position.
Figure 23:
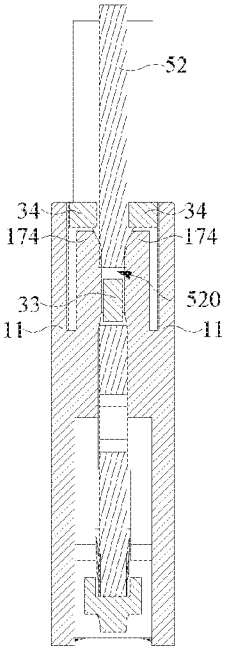
FIG. 23 is a cross sectional plane schematic view of taken along a line A-A of FIG. 22.
Figure 24:
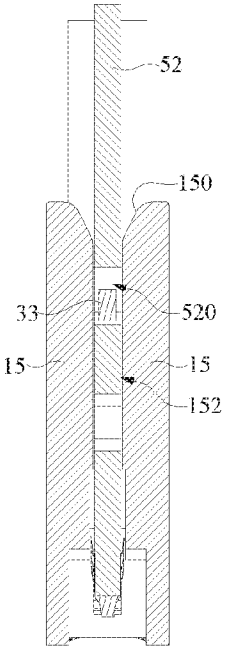
FIG. 24 is a cross sectional plane schematic view of taken along a line B-B of FIG. 22.

FIG. 15 is a cross sectional perspective schematic view with the latching member 3 of FIG. 7 assembled and positioned in a locking position. FIG. 16 is a cross sectional perspective schematic view with the latching member 3 of FIG. 15 in an unlocking position. FIG. 17 is a cross sectional perspective schematic view with the latching member 3 of FIG. 16 in the unlocking position and viewed from another angle, in which the board edge module 5 is shown. FIG. 18 is a plane schematic view of the board edge module 5 and the latching member 3 of FIG. 17 in the unlocking position. FIG. 19 is a cross sectional plane schematic view taken along a line C-C of FIG. 18. FIG. 20 is a cross sectional plane schematic view taken along a line D-D of FIG. 18. FIG. 21 is a cross sectional perspective schematic view of the board edge module 5 and the latching member 3 of FIG. 15 in the locking position viewed from another angle, with the board edge module 5 shown. FIG. 22 is a plane schematic view of the board edge module 5 and the latching member 3 of FIG. 21 in the locking position. FIG. 23 is a cross sectional plane schematic view taken along a line A-A of FIG. 22. FIG. 24 is a cross sectional plane schematic view taken along a line B-B of FIG. 22.

In the process that the board edge module 5 is inserted into the board edge connector 1, the board edge module 5 makes the lower board edge portion 50 insert into the board edge slot 22 of the board edge connector 1 and makes the side board edge portion 52 insert into the guiding groove 152 of the board edge connector 1. The side board edge portion 52 of the board edge module 5 is inserted into the tower portion 24 of the board edge connector 1 from a guiding portion 150 (as shown in FIG. 5) of the tower portion 24, is inserted into the guiding groove 152 and is inserted between the pair of clamping arms 174, here the guiding portion 150 is positioned at an upper end of the guiding groove 152. Moreover, a lower end of the side board edge portion 52 of the board edge module 5 presses against the ejecting portion 32. Therefore, the latching member 3 is rotated about the pivoting shafts 31 to be erected vertically. At the same time, the latching portion 33 of the latching member 3 is configured to latch with a latching notch 520 of the side board edge portion 52 of the board edge module 5 in the locking position, which makes the board edge module 5 to be caught on the board edge connector 1. After insertion, a plurality of contact pads 502 provided on the lower board edge portion 50 of the board edge module 5 are respectively electrically connected to respective contact portions 40 of the conductive terminals 4 of the board edge connector 1. Moreover, in a process changing from the locking position to the unlocking position (vice versa), the buckle block 37 of the latching member 3 will move over the protruding portion 173 of the tower portion 24 and enter into the second groove 172 (as shown in FIG. 6).

Referring to FIG. 15, FIG. 21, FIG. 22, FIG. 23 and FIG. 24, in the locking position, the side board edge portion 52 of the board edge module 5 enters into the recess portion 35 of the triggering portion 36, the position limiting protruding portions 34 are positioned at two sides of the side board edge portion 52. Therefore, the position limiting protruding portions 34 limit the position of the board edge module 5 in the width direction. Moreover, the buckle block 37 of the latching member 3 is positioned in the first groove 171 (as shown in FIG. 6) of the tower portion 24, here the first groove 171 is positioned above the pivoting hole 110 and the protruding portion 173 is positioned between the first groove 171 and the second groove 172.

Referring to FIG. 16, FIG. 17, FIG. 18, FIG. 19 and FIG. 20, when the triggering portion 36 of the latching member 3 is pressed down, the latching member 3 is rotated about the pivoting shafts 31 toward the outer side direction. Therefore, the ejecting portion 32 of the latching member 3 is configured to eject out the side board edge portion 52 of the board edge module 5, which is inserted in the board edge slot 22, in the unlocking position, thereby ejecting out the board edge module 5 from the board edge slot 22. When the latching member 3 is in the unlocking position, an abutting portion 38 of the latching member 3 abuts a step portion 177 of the tower portion 24; and, the buckle block 37 of the latching member 3 is positioned in the second groove 172 (as shown in FIG. 6) of the tower portion 24. Moreover, the pair of clamping arms 174 clamp side surfaces of the side board edge portion 52 of the board edge module 5, which generates a frictional force therebetween. Therefore, when the board edge module 5 is ejected, the board edge module 5 will not fly out. In the embodiment, even when the board edge module 5 is ejected, a part of the pair of the clamping arms 174 may enter into the latching notch 520 of the side board edge portion 52 of the board edge module 5, therefore, the pair of clamping arms 174 can better hold the board edge module 5 when the board edge module 5 is ejected, can better avoid the board edge module 5 jumping out.

Figure 25:
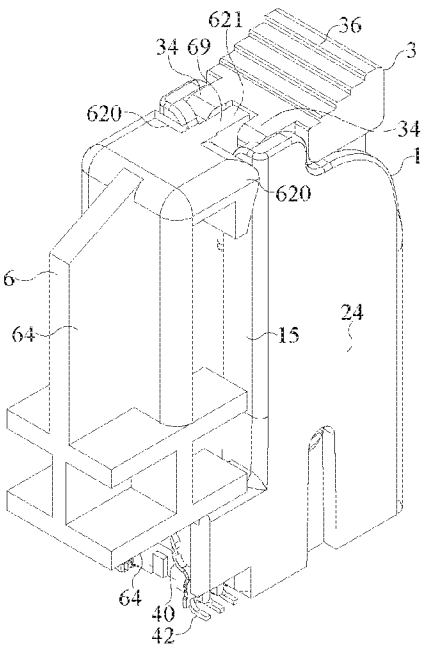
FIG. 25 is a partial enlarged perspective schematic view illustrating that the protecting cover of FIG. 2 is mounted to the board edge connector of FIG. 2 and is positioned in the locking position.
Figure 26:
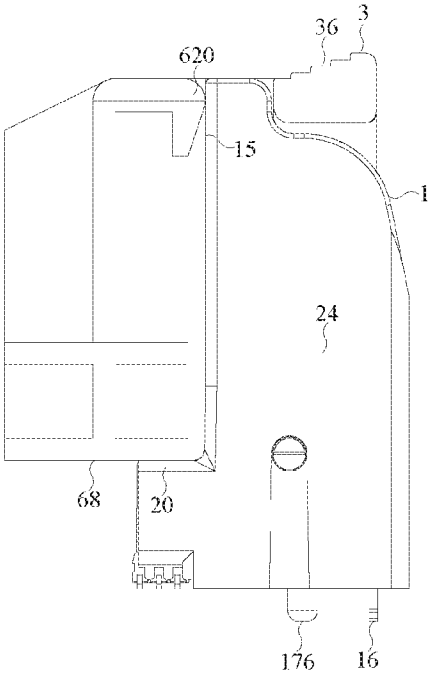
FIG. 26 is a plane schematic view of the protecting cover and the board edge connector of FIG. 25 in the locking position.
Figure 28:
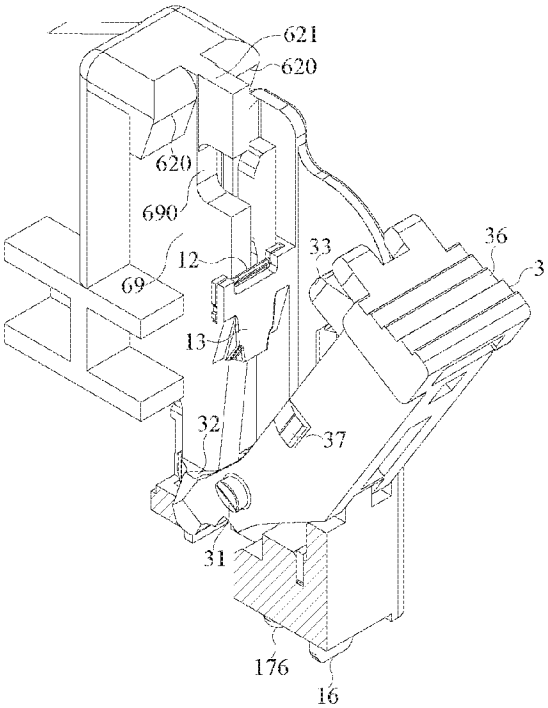
FIG. 28 is a cross sectional perspective schematic view of the protecting cover and the board edge connector of FIG. 27 in the unlocking position.

FIG. 25 is a partial enlarged perspective schematic view illustrating that the protecting cover 6 of FIG. 2 is mounted to the board edge connector 1 of FIG. 2 and is positioned in the locking position. FIG. 26 is a plane schematic view of the protecting cover 6 and the board edge connector 1 of FIG. 25 in the locking position. FIG. 27 is a cross sectional perspective schematic view of the protecting cover 6 and the board edge connector 1 of FIG. 25 in the locking position, with a side wall 11 of the tower portion 24 cut. FIG. 28 is a cross sectional perspective schematic view of the protecting cover 6 and the board edge connector 1 of FIG. 27 in the unlocking position.

Referring to FIG. 2, FIG. 3 and FIG. 25 to FIG. 28, the protecting cover 6 comprises a body portion 61 extending in the length direction and two side edge portions 69 respectively positioned at two ends of the body portion 61 in the length direction. The body portion 61 comprises a top surface 67 (as shown in FIG. 2) and a bottom surface 68 (as shown in FIG. 3). The top surface 67 of the protecting cover 6 acts as a sucking up surface providing a sucking up function to cooperate with a vacuum nozzle or a suction head. Therefore, the protecting cover 6 can cooperate to perform the pick and place operation. The bottom surface 68 of the protecting cover 6 is placed onto the mating face 20 of the board edge connector 1, and covers the board edge slot 22 of the board edge connector 1 and the conductive terminals 4 in the board edge slot 22, as shown in FIG. 25. For example, a width of the bottom surface 68 of the protecting cover 6 is larger than a width of the board edge slot 22 in the width direction. Therefore, the protecting cover 6 may avoid the conductive terminals 4 being contaminated in the process that the board edge connector 1 is welded to the circuit board 9, and may cover the board edge slot 22 when the board edge module 5 is not inserted for use, therefore, the protecting cover 6 has function of dustproof and anti-contamination. In an embodiment, the bottom surface 68 of the protecting cover 6 completely covers the mating face 20 of the board edge connector 1. In another embodiment, the bottom surface 68 of the protecting cover 6 may cover a part of the mating face 20 containing the conductive terminals 4.

The side edge portion 69 comprises a top end 621, as shown in FIG. 2. The top end 621 of the side edge portion 69 is higher than the top surface 67 of the body portion 61 of the protecting cover 6. Moreover, the side edge portion 69 comprises at least one stopping block 620. In an embodiment, one side edge portion 69 is provided with two stopping blocks 620. The two stopping blocks 620 are respectively positioned at two side surfaces of the side edge portion 69 in the width direction, have the same height in the height direction and are close to the top end 621. Moreover, the stopping block 620 can correspondingly stop onto the inner wall 15 of one tower portion 24, as shown in FIG. 25 and FIG. 26. In other embodiments, the side edge portion 69 of the protecting cover 6 may only comprise single stopping block 620. In high temperature process of welding the circuit board, the insulating housing 2 may tend to warpage or deflection deformation due to heat, however, because the stopping block 620 stops the insulating housing 2 of the tower portion 24, the protecting cover 6 can effectively alleviate or eliminate warpage or deflection deformation of the insulating housing 2 of the board edge connector 1 generated in the high temperature process of welding the circuit board, thereby maintaining that the conductive terminals 4 have good coplanarity.

In some embodiments, the stopping block 620 of the protecting cover 6 is preferabley provided to be close to the upper end of the inner wall 15 of the tower portion 24, therefore, the effect that the stopping block 620 stops the tower portion 24 of the insulating housing 2 is better. However, the present disclosure is not limited thereto. In some embodiments, the stopping block 620 may be provided to any appropriate position. In other embodiments, the side edge portion 69 may comprise a plurality of stopping blocks 620 positioned at different heights.

Moreover, the protecting cover 6 further comprises a plurality of rib portions 63, a plurality of corner supporting members 64, a protruding block 65 and two leg portions 66. The rib portion 63 is configured to increase the strength of the protecting cover 6. The corner supporting member 64 also is configured to increase the strength of the protecting cover 6. The protruding block 65 is provided on the bottom surface 68 of the body portion 61, and is configured to stagger with the positioning block 28 formed in the board edge slot 22 of the insulating housing 2 in the length direction. If the orientation of the protecting cover 6 is accidentally reversed to the orientation as shown in FIG. 1 and FIG. 2, for example, is rotated by about 180 degrees, and placed onto the board edge connector 1, the protruding block 65 of the protecting cover 6 will abut the positioning block 28 of the board edge connector 1, which makes that the protecting cover 6 cannot be placed onto the board edge connector 1 and thus can prevent improperly insertion.

Similar to that the board edge module 5 is inserted into the board edge connector 1, referring to FIG. 27, in a process that the protecting cover 6 is mounted to the board edge connector 1, the side edge portion 69 of the protecting cover 6 is inserted into the tower portion 24 of the board edge connector 1, inserted into the guiding groove 152 and inserted into between the pair of clamping arms 174. Moreover, the leg portion 66 of the protecting cover 6 presses against the ejecting portion 32 of the latching member 3. Therefore, the latching member 3 is rotated about the pivoting shafts 31 and erected vertically, changes from the unlocking position into the locking position. The latching portion 33 of the latching member 3 is configured to latch with a latching notch 690 of the side edge portion 69 of the protecting cover 6 in the locking position, makes the protecting cover 6 caught on the board edge connector 1. The two position limiting protruding portions 34 limit the position of the side edge portion 69 of the protecting cover 6 in the width direction.

Referring to FIG. 28, when the triggering portion 36 of the latching member 3 is pressed down, the latching member 3 is rotated about the pivoting shafts 31 toward the outer side direction. Therefore, the ejecting portion 32 of the latching member 3 is configured to eject out the side edge portion 69 of the protecting cover 6 in the unlocking position. Similarly, the pair of clamping arms 174 clamp side surfaces of the side edge portion 69 of the protecting cover 6, which generates frictional force therebetween. In the embodiment, even when the board edge module 5 is ejected, a part of the pair of clamping arms 174 may enter into the latching notch 690 of the side edge portion 69 of the protecting cover 6, therefore, the pair of clamping arms 174 can better hold the protecting cover 6 in the unlocking state.

Figure 29:
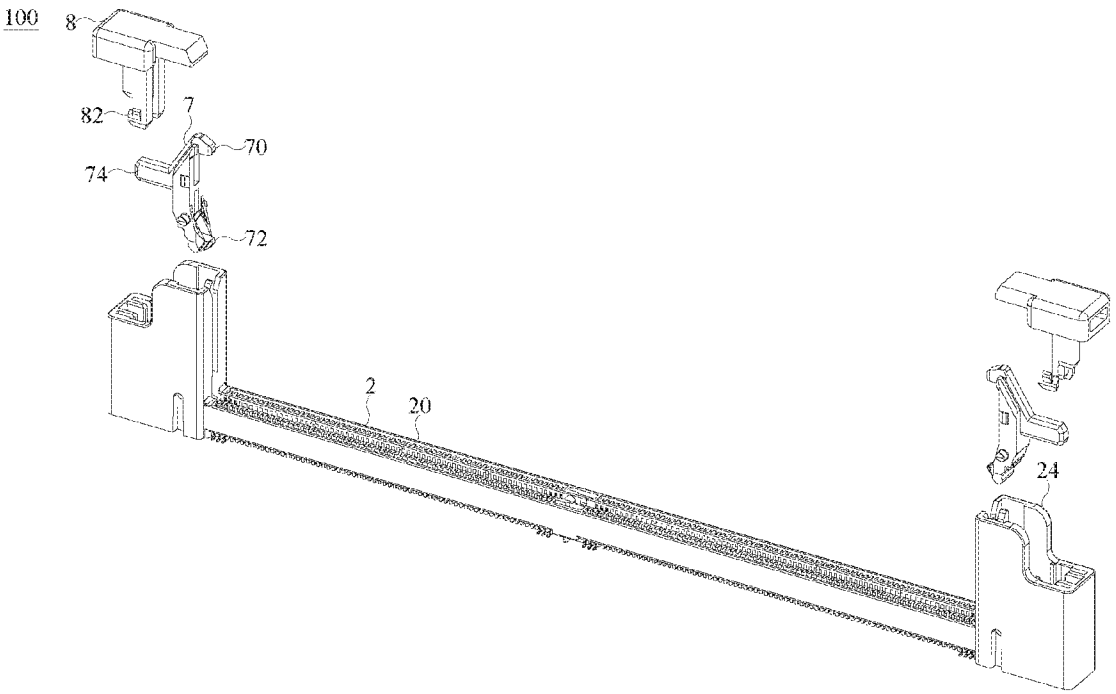
FIG. 29 is a perspective schematic view of a board edge connector of another embodiment of the present disclosure.
Figure 30:
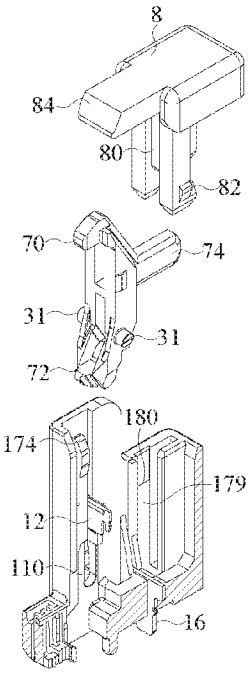
FIG. 30 is a partial cross sectional perspective schematic view of the board edge connector of FIG. 29, with a side wall of tower portion cut.
Figure 31:
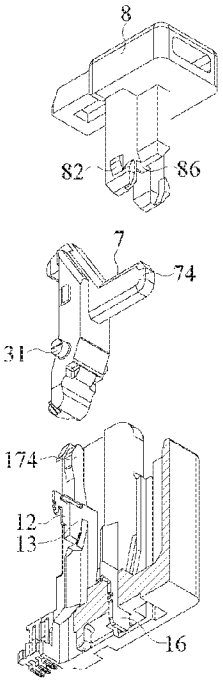
FIG. 31 is a cross sectional perspective schematic view of the board edge connector of FIG. 30 from another angle.
Figure 32:
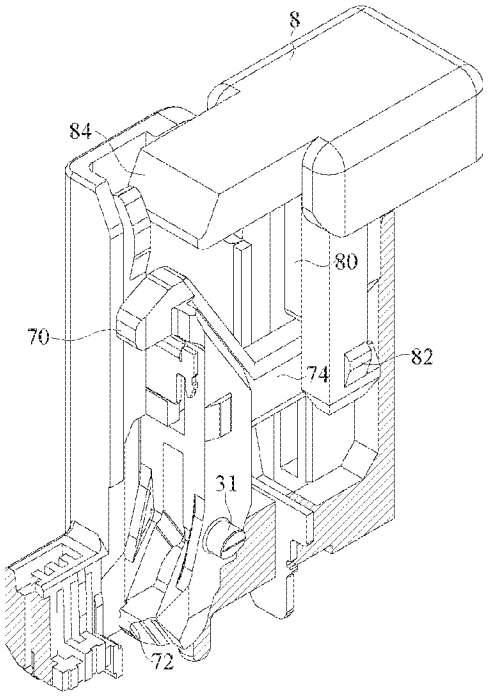
FIG. 32 is a cross sectional perspective schematic view with the latching member of FIG. 30 assembled and positioned in the locking position.

FIG. 29 is a perspective schematic view of a board edge connector 100 of another embodiment of the present disclosure. FIG. 30 is a partial cross sectional perspective schematic view of the board edge connector 100 of FIG. 29, with a side wall 11 of the tower portion 24 cut. FIG. 31 is a cross sectional perspective schematic view of the board edge connector 100 of FIG. 30 from another angle. FIG. 32 is a cross sectional perspective schematic view with the latching member 7 of FIG. 30 assembled and positioned in the locking position.

Referring to FIG. 29 to 32, the board edge connector 100 is similar to the board edge connector 1 shown in FIG. 1, the difference lies in that, the board edge connector 100 comprises a latching member 7 and a pushing member 8.

The manner that the latching member 7 is provided to the insulating housing 2 is similar to the embodiment shown in FIG. 1, so description is omitted herein. The latching member 7 comprises a latching portion 70, an ejecting portion 72 and a following bar 74. The latching portion 70 and the ejecting portion 72 are respectively positioned at two ends of the latching member 7. The pushing member 8 comprises a pushing bar 80, two protruding blocks 82, a guiding surface 84 and a pushing portion 86.

As for the board edge module 5, when the board edge module 5 is inserted into the board edge connector 100, the guiding surface 84 of the pushing member 8 acts as to guide the board edge module 5 to the correct insertion position in the tower portion 24 of the board edge connector 100 when the board edge module 5 offsets. Moreover, the side board edge portion 52 of the board edge module 5 presses against the ejecting portion 72. Therefore, the latching member 7 is rotated about the pivoting shafts 31 and erected vertically. The pushing member 8 is simultaneously lifted by the following bar 74. It should be noted that, the tower portion 24 further comprises a position limiting groove 179, as shown in FIG. 30. An upper end 180 of the position limiting groove 179 is configured to limit the position of the protruding block 82 of the pushing member 8 in an up-down direction. The extent that the pushing member 8 is lifted is thus also limited. The latching portion 70 of the latching member 7 is configured to latch with the latching notch 520 of the side board edge portion 52 of the board edge module 5 in the locking position, which makes the board edge module 5 caught on the board edge connector 100. When the pushing member 8 is pressed down, the pushing portion 86 of the pushing bar 80 of the pushing member 8 is configured to push down the following bar 74 of the latching member 7. Therefore, the latching member 7 is rotated about the pivoting shafts 31. The ejecting portion 72 of the latching member 7 responses to a movement of the following bar 74 pushed down and ejects out the side board edge portion 52 of the board edge module 5 which is inserted into the board edge slot 22, and thus ejects out the board edge module 5 from the board edge connector 100.

As for the protecting cover 6, similar to the above operations of the board edge module 5 and the board edge connector 100, the latching portion 70 of the latching member 7 is configured to latch with the latching notch 690 of the side edge portion 69 of the protecting cover 6 in the locking position, which makes the protecting cover 6 caught on the board edge connector 100.

While the present disclosure and its advantages are described in detail, it is understood that various changes, replacements and substitutions may be made without departing from the spirit and scope of the present disclosure defined by the technical solutions. For example, many processes described above can be implemented in a variety of ways, and many processes described above can be replaced with other processes or combinations thereof.

Further, the scope of the present disclosure is not limited to the specific embodiments of process, machinery, manufacturing, substance composition, means, method or step described in the specification. Those skilled in the art can understand from the disclosed contents of the present disclosure that existing or future developed process, machinery, manufacturing, substance composition, means, method or step which has the same function or achieve essentially the same result as the corresponding embodiment described herein can be used in accordance with the present disclosure. Accordingly, such a process, machinery, manufacturing, substance composition, mean, method or step is included in the technical solution of the present disclosure.

What is claimed is:

1. A protecting cover, used with a board edge connector, the board edge connector comprising an insulating housing and a plurality of conductive terminals; the insulating housing being elongated and extending in a length direction; the insulating housing comprising a board edge slot and at least one tower portion, the tower portion being positioned at an end of the board edge slot, the tower portion having an inner wall facing the board edge slot; the conductive terminals being mounted in the board edge slot, the protecting cover being detachably mounted on the insulating housing, the protecting cover comprising:

a body portion extending in the length direction; and at least one side edge portion positioned at an end of the body portion, the side edge portion comprising at least one stopping block which can correspondingly stop onto the inner wall of the tower portion, wherein the stopping block is close to an upper end of the inner wall of the tower portion.

2. The protecting cover according to claim 1, wherein the insulating housing has a width in a width direction, and wherein the side edge portion comprises two stopping blocks respectively positioned at two side surfaces of the side edge portion in the width direction.

3. The protecting cover according to claim 1, wherein the protecting cover comprises two side edge portions respectively positioned at two ends of the body portion and stopping blocks respectively provided on the two side edge portions, two ends of the board edge slot respectively each have a tower portion, and the stopping blocks on the two side edge portions respectively correspond to the inner walls of the two tower portions.

4. The protecting cover according to claim 1, wherein the body portion of the protecting cover has a bottom surface, the bottom surface covers the board edge slot.

5. The protecting cover according to claim 1, wherein the inner wall of the tower portion comprises a guiding groove communicated with the board edge slot and a pair of clamping arms spaced apart from the guiding groove and positioned alongside the guiding groove, the pair of clamping arms are respectively integrally configured on two side walls of the tower portion and extend upwardly, the side edge portion of the protecting cover is inserted into the guiding groove and is inserted into between the pair of clamping arms, the pair of clamping arms the side edge portion.

6. The protecting cover according to claim 5, wherein the side edge portion is inserted into the tower portion of the board edge connector, the side edge portion of the protecting cover comprises a latching notch;

the board edge connector comprises a latching member, the latching member is provided in the tower portion of the insulating housing, the latching member comprises a latching portion and an ejecting portion, the latching portion is configured to latch with the latching notch of the side edge portion of the protecting cover in a locking position, and the ejecting portion is configured to eject out the side edge portion of the protecting cover in an unlocking position.

7. A board edge connector, comprising:

an insulating housing being elongated and extending in a length direction, the insulating housing comprising:

a board edge slot; and at least one tower portion positioned at an end of the board edge slot, the tower portion comprising an inner wall, the inner wall facing the board edge slot, the inner wall comprising:

a guiding groove in communication with the board edge slot; and a pair of clamping arms positioned in the tower portion, spaced apart from the guiding groove and positioned alongside the guiding groove, an interval between the pair of clamping arms being smaller than a width of the guiding groove, wherein the tower portion comprises a position limiting surface which is positioned in the tower portion, spaced apart from the pair of clamping arms and positioned alongside the pair of clamping arms.

8. The board edge connector according to claim 7, wherein the pair of clamping arms are respectively integrally configured on two side walls of the tower portion and extend upwardly.

9. The board edge connector according to claim 7, wherein the tower portion comprises a partitioning wall which is positioned in the tower portion and positioned alongside the pair of clamping arms, the partitioning wall comprises an inner surface which faces the board edge slot and acts as the position limiting surface.

10. The board edge connector according to claim 7, wherein the tower portion comprises:

a partitioning wall which is positioned in the tower portion and positioned alongside the pair of clamping arms, the partitioning wall comprises a wall surface, the wall surface faces the board edge slot; and a metal reinforcement member which is positioned on the wall surface of the partitioning wall, the metal reinforcement member comprises an inner surface which faces the board edge slot and acts as the position limiting surface.

11. The board edge connector according to claim 10, wherein the metal reinforcement member further comprises a guiding edge which bends toward an outer side direction, the guiding edge is positioned at an upper edge of the metal reinforcement member.

12. The board edge connector according to claim 7, wherein the board edge connector is used to receive a board edge module, the board edge module has a side board edge portion, the side board edge portion comprises a latching notch, the board edge connector further comprises a latching member provided in the tower portion of the insulating housing, the latching member comprises a latching portion and an ejecting portion, the latching portion is configured to latch with the latching notch of the board edge module in a locking position, and the ejecting portion is configured to eject out the side board edge portion of the board edge module in an unlocking position.

13. A board edge connector, comprising:

an insulating housing being elongated and extending in a length direction, the insulating housing comprising:

a board edge slot; and at least one tower portion positioned at an end of the board edge slot, the tower portion comprising an inner wall, the inner wall facing the board edge slot, the inner wall comprising:

a guiding groove in communication with the board edge slot; and a pair of clamping arms positioned in the tower portion, spaced apart from the guiding groove and positioned alongside the guiding groove, an interval between the pair of clamping arms being smaller than a width of the guiding groove, wherein the board edge connector is used to receive a board edge module, the board edge module has a side board edge portion, the side board edge portion comprises a latching notch, the board edge connector further comprises:

a latching member comprising:

a latching portion configured to latch with the latching notch of the board edge module in a locking position;

an ejecting portion, the ejecting portion and the latching portion are positioned at two ends of the latching member; and a following bar; and a pushing member comprising:

a pushing bar configured to push down the following bar of the latching member in an unlocking position, the ejecting portion of the latching member responses to a movement of the following bar pushed down and ejects out the side board edge portion of the board edge module.

* * * * *